US008708510B2

(12) United States Patent
Chen et al.

(10) Patent No.: US 8,708,510 B2
(45) Date of Patent: Apr. 29, 2014

(54) ROTATABLE LIGHTING APPARATUS

(75) Inventors: Chin-Liang Chen, Taichung (TW); Zhi-Ting Ye, Miaoli County (TW); Ming-Chuan Lin, Taichung (TW)

(73) Assignees: Dongguan Masstop Liquid Crystal Display Co., Ltd., Guangdong Province (CN); Wintek Corporation, Taichung (TW)

( * ) Notice: Subject to any disclaimer, the term of this patent is extended or adjusted under 35 U.S.C. 154(b) by 180 days.

(21) Appl. No.: 13/468,033

(22) Filed: May 10, 2012

(65) Prior Publication Data

US 2012/0287653 A1 Nov. 15, 2012

(30) Foreign Application Priority Data

May 13, 2011 (TW) ..... 100116874 A

(51) Int. Cl.
*F21V 21/30* (2006.01)
*F21V 21/14* (2006.01)
*F21V 17/12* (2006.01)

(52) U.S. Cl.
USPC ..... 362/35; 362/430

(58) Field of Classification Search
USPC ..... 362/35, 430
See application file for complete search history.

(56) References Cited

U.S. PATENT DOCUMENTS 4,164,784 A * 8/1979 Jaksich ..... 362/282
5,325,281 A * 6/1994 Harwood ..... 362/271
6,402,352 B1 * 6/2002 Summerford et al. ..... 362/426
6,644,829 B1 * 11/2003 Tracy et al. ..... 362/220
7,530,705 B2 * 5/2009 Czech et al. ..... 362/147
8,075,163 B2 * 12/2011 Xiao et al. ..... 362/287
8,534,870 B2 * 9/2013 Wu ..... 362/249.03

FOREIGN PATENT DOCUMENTS

TW M332788 5/2008

OTHER PUBLICATIONS

"Office Action of Taiwan Counterpart Application", issued on Jan. 31, 2013, p. 1-p. 4.

* cited by examiner

*Primary Examiner* — Stephen F Husar
*Assistant Examiner* — James Cranson, Jr.
(74) *Attorney, Agent, or Firm* — Jianq Chyun IP Office

(57) ABSTRACT

A rotatable lighting apparatus includes a terminal, a base which includes a protruding part at a junction portion thereof, a rotatable lamp holder pivoted at the base and including a heat dissipation part and a lighting source, a passing-through device passing through the base and the rotatable lamp holder, and a bellow device connected to the base and the rotatable lamp holder. The heat dissipation part has a plurality of restricting trenches for fastening to the protruding part. When a tensile force is applied to the rotatable lamp holder, the rotatable lamp holder is capable of moving relative to the base along a moving-axis, so that the rotatable lamp holder is capable of rotating relative to the base. When the tensile force is removed, the rotatable lamp holder is fastened to one of the restricting trenches, so that the rotatable lamp holder is fixed to the base.

9 Claims, 7 Drawing Sheets

ROTATABLE LIGHTING APPARATUS

CROSS-REFERENCE TO RELATED APPLICATION

This application claims the priority benefit of Taiwan application serial no. 100116874, filed on May 13, 2011. The entirety of the above-mentioned patent application is hereby incorporated by reference herein and made a part of this specification.

TECHNICAL FIELD

The disclosure is related to a lighting apparatus, and in particular to a lighting apparatus with a rotatable mechanism.

BACKGROUND OF THE INVENTION

FIG. 1 is a schematic diagram of a conventional lighting apparatus module. A lighting source 110 is fixed to and electrically connected to a base 130 through a terminal 120. Since light emitted from the lighting source 110 irradiates at 360 degrees, in order that the light emitted from the lighting source 110 irradiates a user 150, a reflective cover 140 is additionally disposed in a conventional lighting apparatus module 100. A portion of the light that travels away from the user 150 is reflected to irradiate the user 150, so that intensity of the light that is able to be used by the user 150 is increased.

However, although the reflective cover 140 reflects the portion of the light to the user, due to restrictions by a material of the reflective cover 140, the light that travels away from the user 150 is not completely reflected and a portion thereof is lost. However, due to restrictions by dimensions of the reflective cover 140, at some areas that do not have the reflective cover 140, some light is still not effectively reflected to the user. In general, a lighting efficiency of the lighting apparatus module is therefore only 50%-70%. In other words, the conventional lighting apparatus module 100 may have problems of low lighting efficiency.

SUMMARY OF THE INVENTION

The disclosure provides a rotatable lighting apparatus, wherein a lamp holder thereof is able to rotate relative to a base, so that a user is able to adjust a light emitting direction of a lighting source according to requirements, and no additionally disposed reflective covers are required.

The disclosure provides a rotatable lighting apparatus which includes a terminal, a base, a rotatable lamp holder, a passing-through device, and a bellow device. The terminal is fixed to the base, and a junction portion of the base opposite to the terminal includes at least one protruding part. The rotatable lamp holder is pivoted at the junction portion of the base and includes a heat dissipation part and a lighting source. The heat dissipation part includes a plurality of restricting trenches for fastening to the protruding part, and the lighting source is fixed to a single surface of the heat dissipation part. The passing-through device passes through the base and the rotatable lamp holder, and the rotatable lamp holder is able to move relatively on the passing-through device along a moving-axis. The bellow device is connected to the base and the rotatable lamp holder, when a tensile force is applied to the rotatable lamp holder, the rotatable lamp holder is capable of moving relative to the base along the moving-axis, so that the protruding device is departed from the corresponding restricting trench, and thus the rotatable lamp holder is capable of rotating relative to the base, when the tensile force is removed, the rotatable lamp holder is fastened to one of the restricting trenches by resilience of the bellow device, so that the rotatable lamp holder is fixed on the base.

The disclosure also provides a rotatable lighting apparatus which includes a terminal, a base, and a rotatable lamp holder. The base is fixed on the terminal, wherein an end of the base opposite to the terminal includes a protruding portion, and an outer wall of the protruding portion includes at least one locking protruding ring. The rotatable lamp holder is pivoted at the protruding portion of the base and includes a heat dissipation part and a lighting source. The heat dissipation part includes a receding part for housing the protruding portion, a circumference of the receding part includes at least one locking receding ring for fastening to the locking protruding ring. The lighting source is fixed on a single face of the heat dissipation part. After the locking receding ring is fastened to the locking protruding ring, the rotatable lamp holder only has one degree of rotational freedom relative to the axis of the base, and the rotational freedom exceeds 360 degrees.

In summary, the rotatable lighting apparatus according to the disclosure includes a rotatable lamp holder which is able to rotate relative to the terminal. Therefore, the user is able to adjust the lighting source to the required light emitting angle, and no additional reflective covers need to be disposed to guide the light emitting direction. The lighting efficiency of the lighting apparatus is hence increased.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
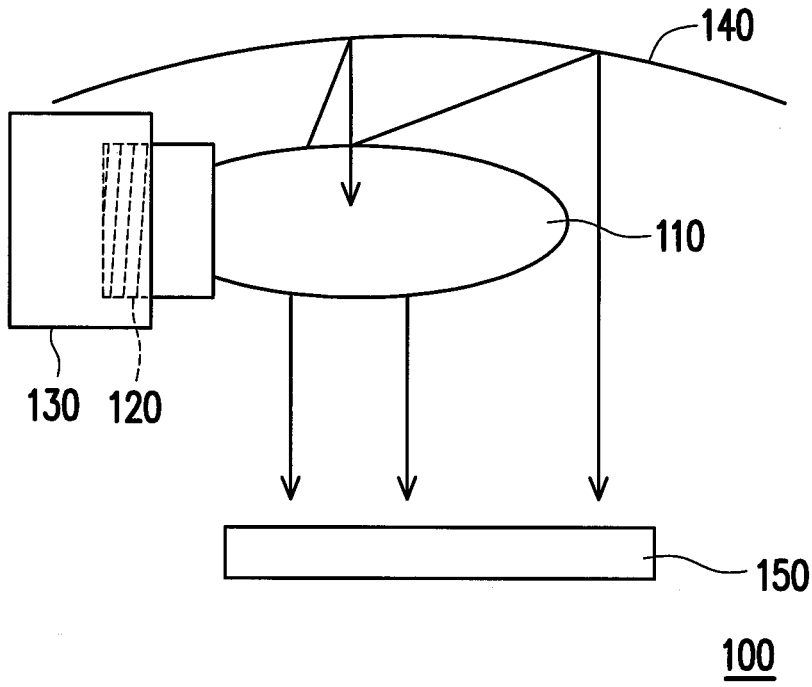
FIG. 1 (RELATED ART)
FIG. 1 is a schematic diagram of a conventional lighting apparatus module.
Figure 2:
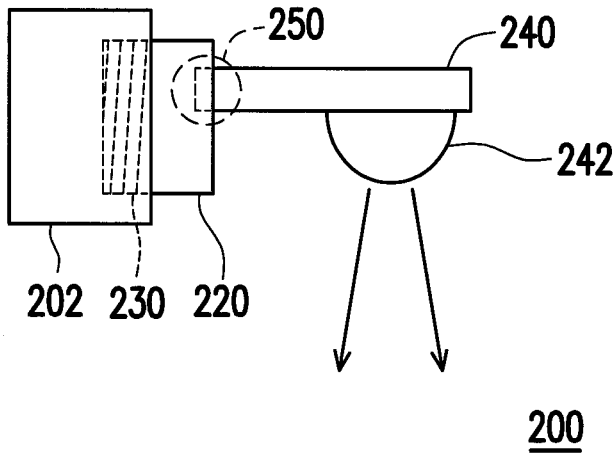
FIG. 2 is a schematic diagram of a rotatable lighting apparatus according to the disclosure.

Please refer to FIG. 2. A rotatable lighting apparatus 200 according to the disclosure includes a rotatable lamp holder 240, a base 220, and a terminal 230, wherein the terminal 230 is fixed on the base 220, and the rotatable lamp holder 240 includes a rotatable mechanism 250, so that the rotatable lamp holder 240 is able to rotate relative to the base 220. Therefore, a lighting source 242 on a single face of the rotatable lamp holder 240 is not restricted by the screw joint between the terminal 230 and the base 220, and is able to be adjusted to any required angle. Hence, light emitted from the lighting source 242 irradiates towards a predetermined direction, thereby greatly increasing light use efficiency. Also, in addition to enabling the rotatable lamp holder 240 to rotate relative to the base 220, the rotatable mechanism 250 according to the disclosure also suitably joins the rotatable lamp holder 240 and the base 220 during rotation, thereby preventing the rotatable lamp holder 240 from detaching from the base 220. In order to clearly describe the rotatable lighting apparatus according to the disclosure, the following provides a plurality of embodiments for description. However, the following embodiments do not limit the disclosure.

First Embodiment

Figure 3:
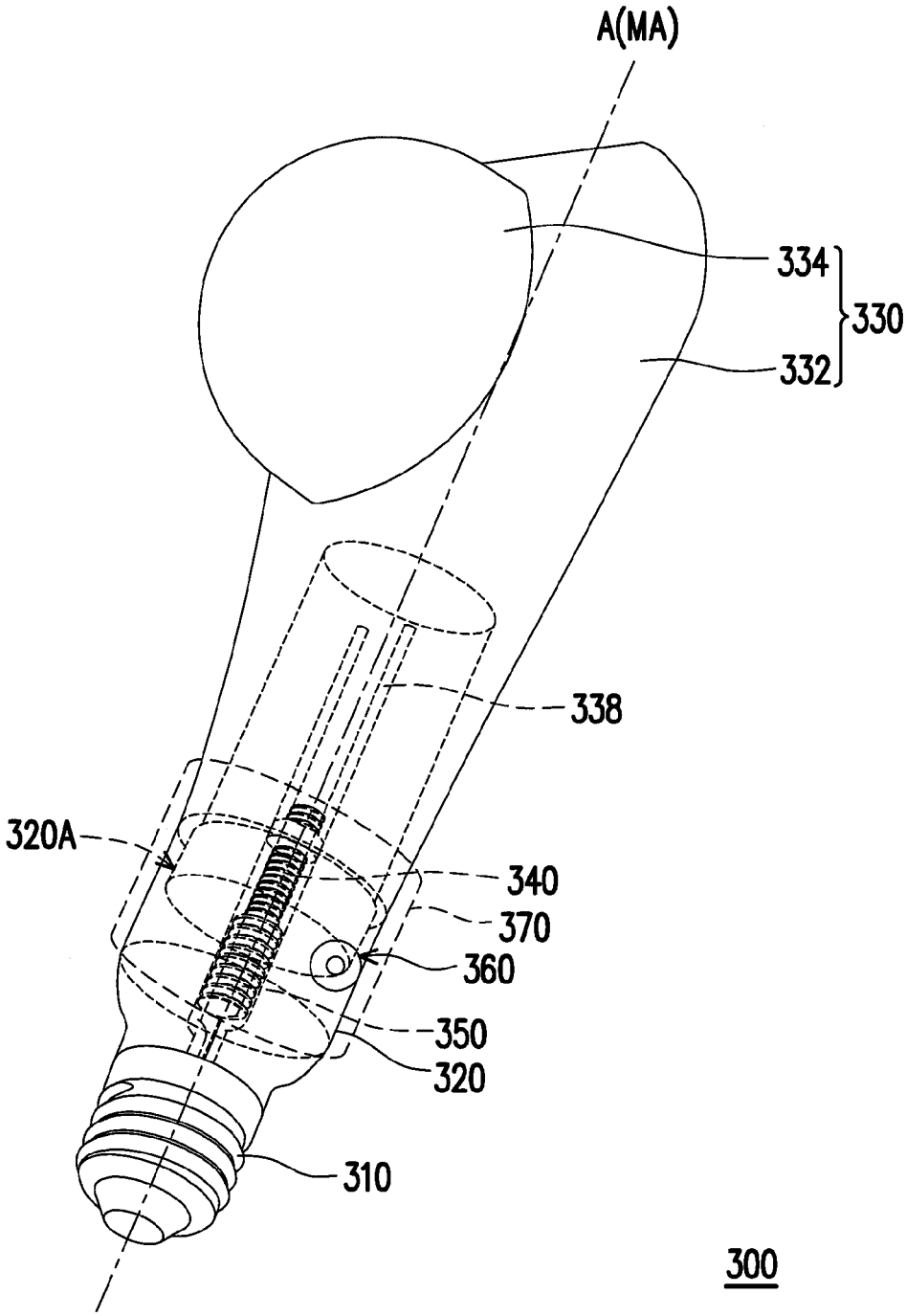
FIG. 3 is a schematic perspective diagram of a rotatable lighting apparatus according the first embodiment of the disclosure.

Please refer to FIG. 3. A rotatable lighting apparatus 300 according to the disclosure includes a terminal 310, a base 320, a rotatable lamp holder 330, a passing-through device 340, and a bellow device 350. The terminal 310 is fixed on the base 320. The rotatable lamp holder 330 includes a heat dissipation part 332 and a lighting source 334. The lighting source 334 is fixed to a single face of the heat dissipation part 332, wherein the lighting source 334 is, for example, a light emitting diode module. Hence, light emitted by the lighting source 334 has a certain degree of collimation, so that by simply adjusting an angle of the heat dissipation part 332 relative to the base 320, the light from the lighting source 334 is emitted straight towards a predetermined angle, thereby avoiding unnecessary light loss.

In addition, the rotatable lamp holder 330 is pivoted at a junction portion 320A of the base 320 through the heat dissipation part 332. According to the present embodiment, the rotatable lighting apparatus 300 further includes a conducive wire 338 which passes through the base 320 and the rotatable lamp holder 330, so as to be electrically connected between the terminal 310 and the lighting source 334. The passing-through device 340 passes through the base 320 and the rotatable lamp holder 330. The passing-through device 350 connected to the base 320 and the rotatable lamp holder 330. The rotatable lamp holder 330 is capable of moving along a moving-axis MA through the passing-through device 340 and the bellow device 350.

In detail, the rotatable lamp holder 330 and the base 320 have corresponding fastening elements 360. According to the present embodiment, by using the fastening elements 360 and the bellow device 350, the rotatable lamp holder 330 is able to rotate relative to the base 320. After rotating to a predetermined light emitting angle, the rotatable lamp holder 330 is fixed at the predetermined angle through the cooperating fastening elements 360 and bellow device 350.

Figure 4:
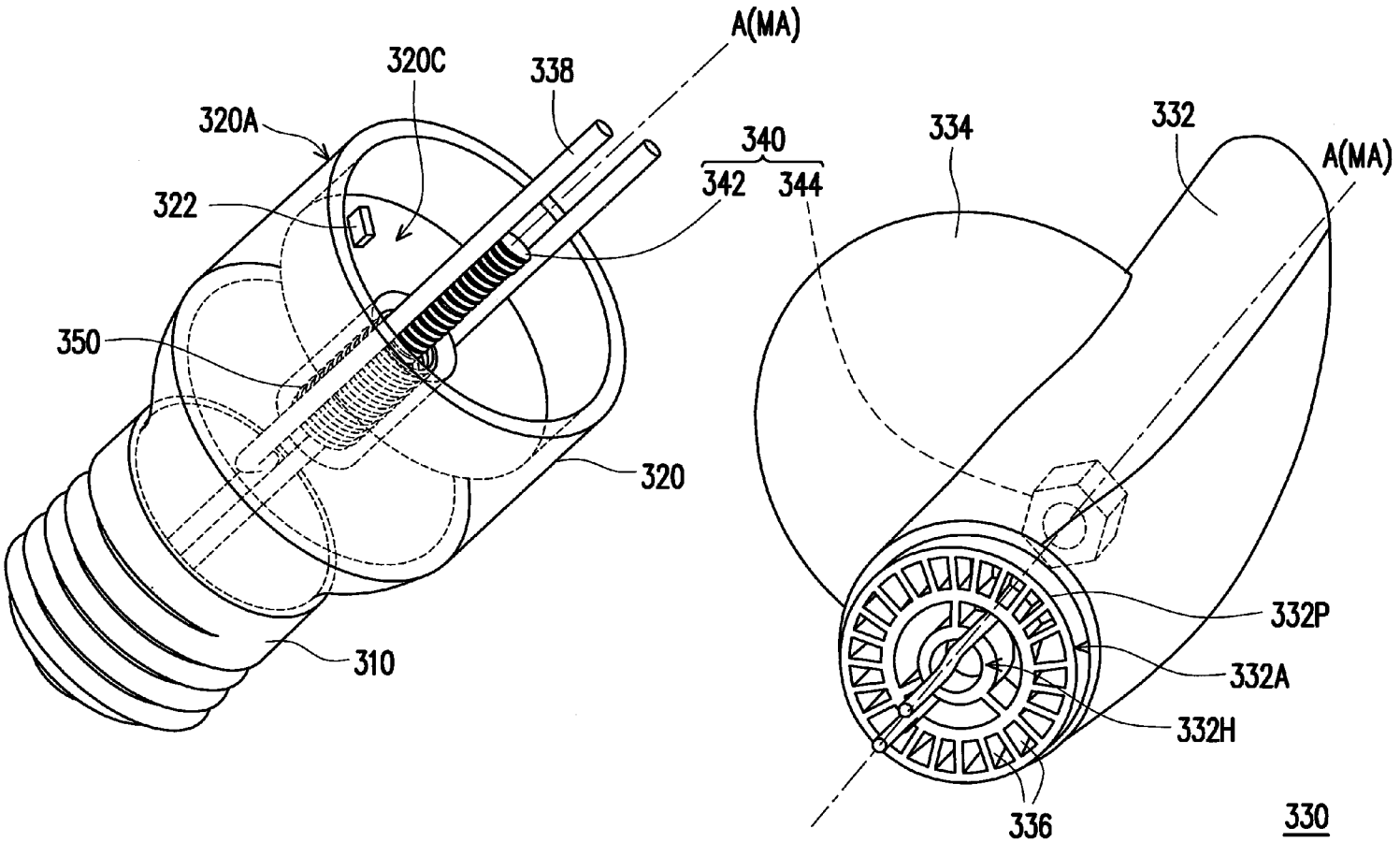
FIG. 4 is a schematic diagram of the disassembled rotatable lighting apparatus in FIG. 3.

In further detail, please refer to the left side of FIG. 4. The junction portion 320A of the base 320 includes at least one protruding part 322 and a receding part 320C which is able to house a portion of the rotatable lamp holder 330, and the protruding part 322 is, for example, disposed on a bottom surface of the receding part 320C. However, the disclosure is not limited to this configuration.

On the other hand, please refer to the right side of FIG. 4. The heat dissipation part 332 on the rotatable lamp holder 330 includes a junction portion 332A which is joined to the base 320, and a plurality of restricting trenches 336 for fastening to the protruding part 322 is disposed on the junction portion 332A. These restricting trenches 336 are, for example, arranged equidistantly along a circle with the same radius. It should be noted that according to the present embodiment, only one protruding part 322 is shown as an example. However, the disclosure is not limited to this configuration. As long as numbers, arrangements, and shapes of the protruding part 322 and the restricting trenches 336 correspond to each other, a designer is able to select a suitable protruding part 322 and restricting trenches 336 according to product dimensions, requirements, or junction strength between the rotatable lamp holder 330 and the base 320.

According to the present embodiment, the heat dissipation part 332 includes, for example, a protruding portion 332P, and the restricting trenches 336 are arranged on a surface of the protruding portion 332P in a circular manner. Also, the protruding portion 332P includes an opening 332H on an axis A, so that the passing-through device 340 passes through. The passing-through device 340 is, for example, formed by a screw 342 and a nut 344. In other words, according to the present embodiment, the axis A of the rotatable lamp holder 330 and the axis A of the base 320 overlap with the moving-axis MA, for example.

Figure 5A:
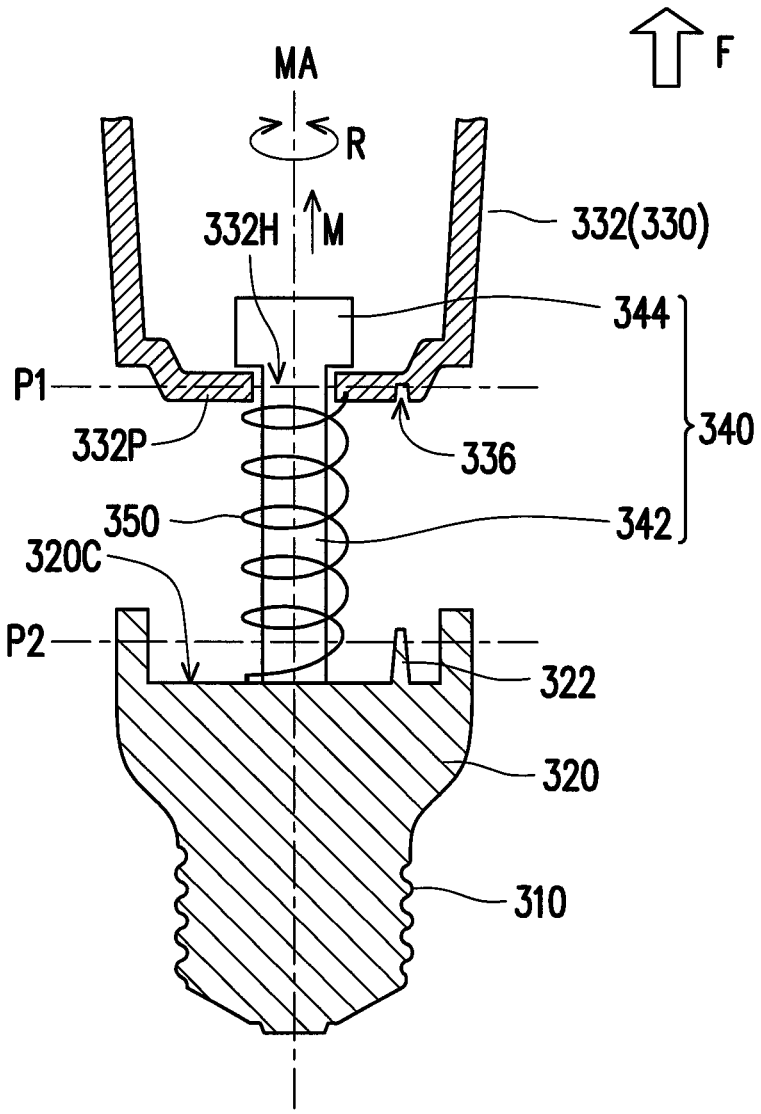
FIG. 5A and FIG. 5B are schematic cross-sectional diagrams showing a rotatable lighting apparatus when a tensile force is applied thereto and when the tensile force is removed, respectively, according to the first embodiment of the disclosure.
Figure 5B:
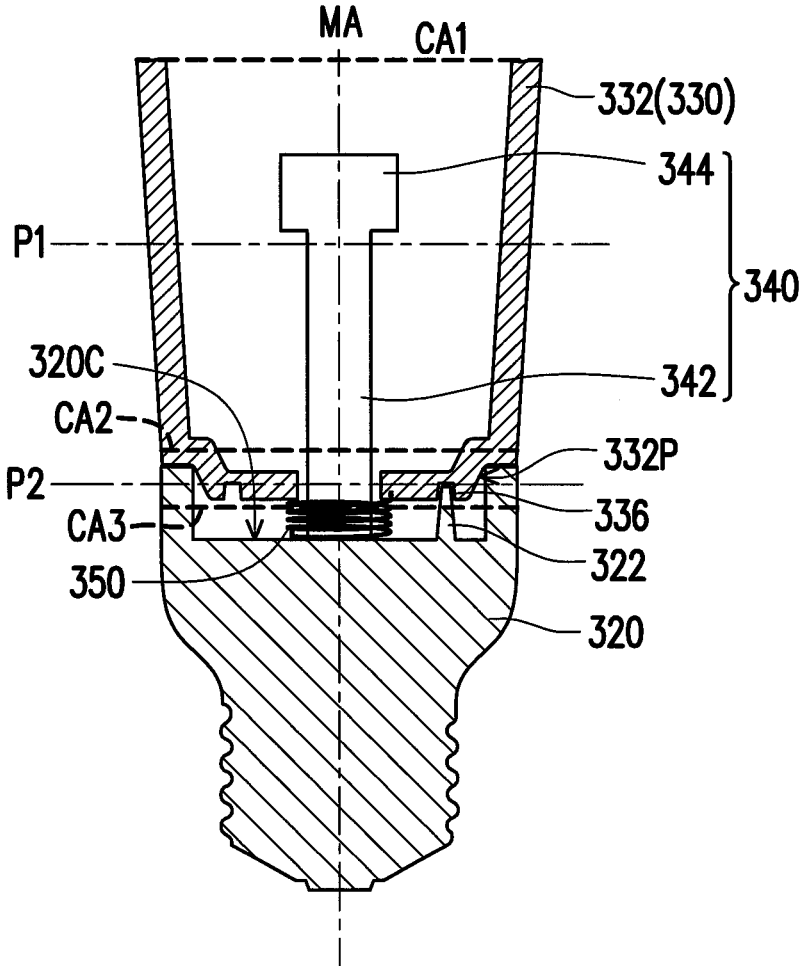

In order to clearly describe the rotation mechanism 370 and a rapid fastening mechanism of the rotatable lamp holder 300 according to the present embodiment, the following refers to FIG. 5A and FIG. 5B to describe an adjusting mechanism of the rotatable lighting apparatus. The disclosure, however, is not limited to the following depicted forms.

Please refer to FIGS. 4, 5A, and 5B. The screw 342 passes through the base 320 the opening 332H of the protruding portion 332P. The nut 344 is disposed at an internal wall of the rotatable lamp holder 330 and is fixed on the screw 342 which passes through the opening 332H, so that movement of the rotatable lamp holder 330 is restricted between the nut 344 and the base 320. The bellow device 350 according to the present embodiment is, for example, formed by a spring.

Please refer to FIG. 5A, when a tension force F is applied to the rotatable lamp holder 330, the rotatable lamp holder 330 is able to move relative to the base 320 along the moving-axis MA, as shown by a moving direction M in the drawings. Therefore, the protruding part 322 is departed from the corresponding restricting trench 336, and thus the rotatable lamp holder 330 is capable of rotating relative to the base 320, as shown by a rotating direction R in the drawings. Moreover, as shown in FIG. 5A, the rotatable lamp holder 330 is able to move between a first position P1 and a second position P2 of the passing-through element 340 along the moving direction M. It should be noted that the movement of the rotatable lamp holder 330 may be determined by elasticity of the bellow device 350 along the moving direction. It should be also noted that the movement of the rotatable lamp holder 330 may also be altered through adjusting the position of the nut 344. For example, after the nut 344 is screwed towards the base 320, a distance between the first position P1 and the second position P2 of the passing-through device 340 also decreases, and thus operability and fastening stability between the base 320 and the rotatable lamp holder 330 are altered.

Still referring to FIG. 5B, when the tensile force F is removed, the rotatable lamp holder 330 rapidly returns to the second position P2 by the resilience of the bellow device 350. At this moment, the heat dissipation part 332 extends into the receiving part 320C of the base 320 through the protruding part 332, so that the protruding part 322 in the receiving part 320C correspondingly extends into one of the restricting trenches 336 of the protruding portion 332P, so that the rotatable lamp holder 330 is fixed on the base 320.

It should be noted that when the user adjusts a rotating angle of the rotating lamp holder 330 relative to the base 320, elastic deformation occurs in the bellow device 350 along the screwing direction, and the bellow device 350 hence suitably stores elastic potential. As the elastic potential stored in the bellow device 350 increases, a counteraction force against the elastic potential is generated. Therefore, the user is suitably reminded to rotate the rotatable lamp holder 330 in the opposite direction, so as to prevent excessive rotation of the rotatable lamp holder 330, which will cause the rotatable lamp holder 330 to be departed from the base 320.

Furthermore, according to the present embodiment, cross-sectional areas of the rotatable lamp holder 330 perpendicular to the moving-axis MA gradually increase from the protruding portion 332P towards the other end. For example, a cross-sectional area CA1 of the rotatable lamp holder 330 away from the protruding portion 332P is greater than a cross-sectional area CA2 of the rotatable lamp holder 330 near the protruding portion 332P. Therefore, the user uses his or her hand to apply a force at the end with a greater cross-sectional area (such as the cross-sectional area CA1) to adjust an angle between the end with a smaller cross-sectional area (such as the cross-sectional area CA2) and the base 320. The user is thus able to use a smaller force to achieve rotation, and convenience and user-friendliness of adjustment are increased.

In light of the above, according to requirements, the user is able to rapidly and easily adjust the lighting source to the required light emitting angle, and no additional reflective covers need to be disposed to guide the light emitting direction. The lighting efficiency of the lighting apparatus is therefore increased.

Second Embodiment

Figure 6A:
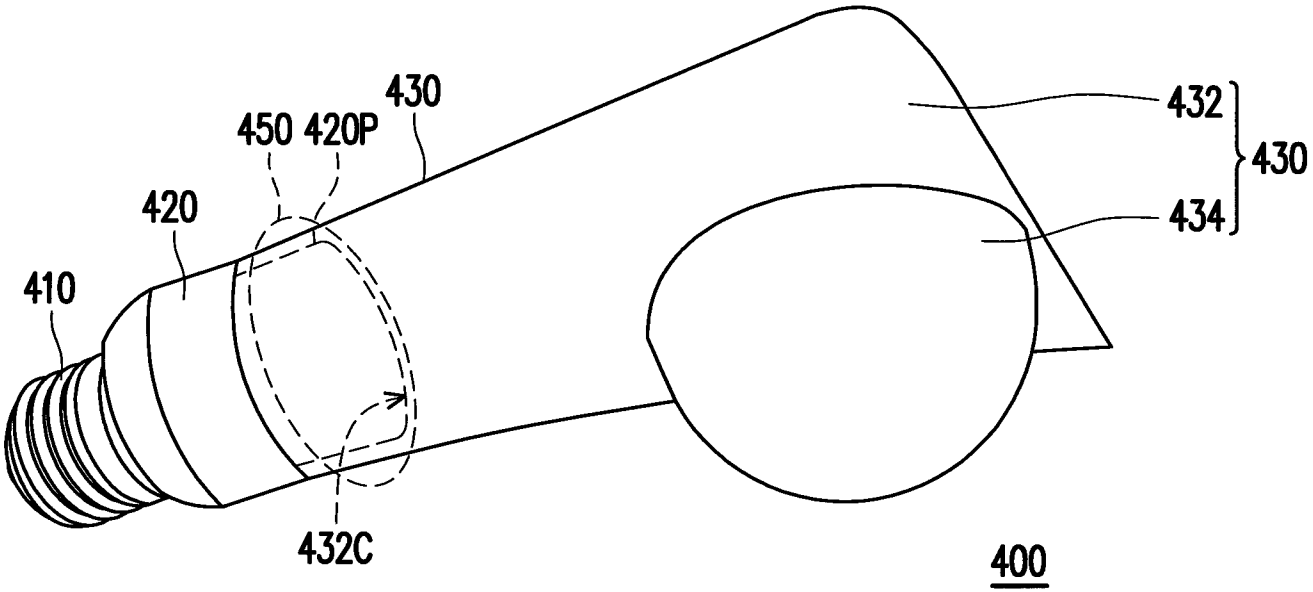
FIG. 6A and FIG. 6B are a schematic structural diagram and a schematic cross-sectional diagram of a rotatable lighting apparatus according to the second embodiment of the disclosure.
Figure 6B:
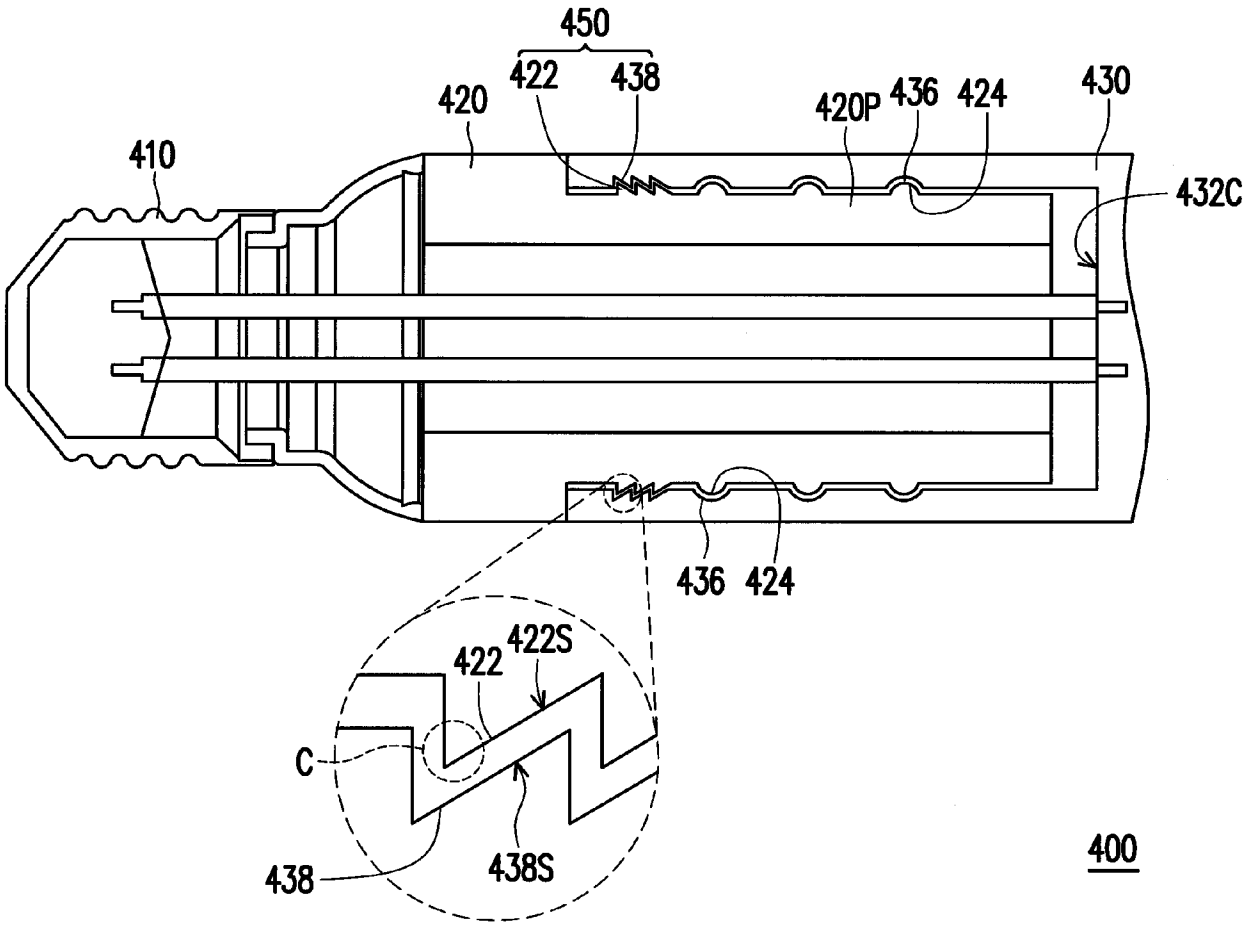

Please refer to FIG. 6A and FIG. 6B. A rotatable lighting apparatus 400 is similar to that according to the first embodiment. A main difference is that the rotatable mechanism is different. In detail, the rotatable lighting apparatus 400 according to the present embodiment includes a terminal 410, a base 420, and a rotatable lamp holder 430. The base 420 is fixed to the terminal 410, and an end of the base 420 opposite to the terminal 410 includes a protruding portion 420P. An external surface of the protruding portion 420P includes at least one locking protruding ring 422. The rotatable lamp holder 430 is pivoted at a protruding portion 420P of the base 420 and includes a heat dissipation part 432 and a lighting source 434. The lighting source 434 is fixed on a single face of the heat dissipation part 432. The heat dissipation part 432 includes a receding part 432C for housing the protruding portion 420P, and a circumference of the receding part 432C includes at least one locking receding ring 438 for fastening to the locking protruding ring 422, so as to provide a rotatable mechanism 450. Therefore, when the locking receding ring 438 is fastened to the locking protruding ring 422, the rotatable lamp holder 430 only has one degree of rotational freedom relative to an axis of the base 420, and the rotational freedom is more than 360 degrees.

In further detail, on a circumference of the receding part 432C of the rotatable lamp holder 430, the locking receding ring 438 is embodied as a closed circle instead of an open spiral, and on an outer wall of the protruding portion 420P of the base 420, the locking protruding ring 422 is also embodied as a closed circle. After the locking receding ring 438 is fastened to the locking protruding ring 422, when the rotatable lamp holder 430 is rotated, the rotatable lamp holder 430 is able to be rotated for more than 360 degrees along a track of the locking protruding ring 422 of the base 420. Moreover, since both the locking receding ring 438 on the circumference of the receding part 432C and the locking protruding ring 422 on the outer wall of the protruding portion 420P are embodied as a closed circle, when the rotatable lamp holder 430 is rotated, the rotatable lamp holder 430 does not slide along an axial direction of the base 420 but only has the rotational freedom relative to the axis of the base 420. In other words, even if the user excessive rotates of the rotatable lamp holder 430, the rotatable lamp holder 430 still does not move along the axial direction, so that detachment of the rotatable lamp holder 430 from the base 420 due to excessive rotation is thus avoided.

Moreover, as shown in FIG. 6B, each of the locking protruding ring 422 and the locking receding ring 438 has an angular structure C which faces the terminal 410. The locking protruding ring 422 includes a first slope 422S, and the locking receding ring includes a second slope 438S which corresponds to the first slope 422S. When the rotatable lamp holder 430 is pivoted at the base 420, the first slope 422S of the locking protruding ring 422 guides the second slope 438S of the locking receding ring 438, so that the locking receding ring 438 of the rotatable lamp holder 430 smoothly enters and is fastened to the locking protruding ring 422 of the base 420.

When the locking protruding ring 422 is fastened to the locking receding ring 438, the angular structure C prevents the rotatable lamp holder 430 from detaching from the base 420. In other words, according to the present embodiment, the locking protruding ring 422 and the locking receding ring 438 are, for example, fastened uni-directionally, and the locking mechanism prevents detachment at the opposite direction. A designer may suitably adjust positions and numbers of the locking protruding ring 422 and the locking receding ring 438 according to factors such as a size of the lighting apparatus, sizes and weights of the rotatable lamp holder and the base, a force application range by the user, and product requirements. For example, according to the present embodiment, a number of the locking protruding ring 422 and the locking receding ring 428 is, for example, three, and a position thereof is, for example, at the protruding portion 420P of the base 420 near the terminal 410. Taking into consideration the further fortification of mechanical coupling strength between the rotatable lamp holder 430 and the base 420, a protruding ring 424 may be additionally disposed on the protruding portion 420P of the base 420, and a receding ring 436 corresponding to the protruding ring 424 is also disposed on the circumference of the receding part 432C of the heat dissipation part 432 for fastening to the protruding ring 424, as shown in FIG. 6B. Therefore, mechanical fastening strength between the rotatable lamp holder 430 and the base 420 is further increased. However, the disclosure is not limited to this configuration. According to another embodiment, the receding ring 436 is not disposed on the circumference of the receding part 432C of the heat dissipation part 432 of the protruding ring 424. Instead, the protruding ring 424 directly presses against the circumference (not shown) of the receding part 432C, hence providing some friction, so that the rotatable lamp holder 430 which is already rotated to the required angle is not further rotated relative to the base 420. However, the disclosure is not limited to this configuration.

In light of the above, according to the present embodiment, lighting efficiency of the lighting apparatus is also increased. Through cooperation between the locking protruding ring and the locking receding ring, the rotatable lamp holder only has one degree of rotational freedom relative to the axis of the base, and this rotational freedom exceeds 360 degrees, so that the adjusting angle by the user is not limited. Detachment of the rotatable lamp holder from the base is effectively prevented.

It will be apparent to those skilled in the art that various modifications and variations can be made to the disclosure without departing from the scope or spirit of the disclosure. In view of the foregoing, it is intended that the disclosure cover modifications and variations of this disclosure provided they fall within the scope of the following claims and their equivalents.

What is claimed is:

1. A rotatable lighting apparatus, comprising:

a terminal;

a base, wherein the terminal is fixed on the base, an end of the base opposite to the terminal forms a junction portion, and the junction portion includes at least one protruding part;

a rotatable lamp holder, pivoted at the junction portion of the base and comprising:

a heat dissipation part, comprising a plurality of restricting trenches for fastening to the protruding part; and a lighting source, fixed on a single face of the heat dissipation part;

a passing-through device, passing through the base and the rotatable lamp holder, and the rotatable lamp holder is able to move relatively to the passing-through device along a moving-axis; and a bellow device, connected to the base and the rotatable lamp holder, when a tensile force is applied to the rotatable lamp holder, the rotatable lamp holder is capable of moving relative to the base along the moving-axis, so that the protruding device is departed from the corresponding restricting trench, and thus the rotatable lamp holder is capable of rotating relative to the base, when the tensile force is removed, the rotatable lamp holder is fastened to one of the restricting trenches by resilience of the bellow device, so that the rotatable lamp holder is fixed on the base.

2. The rotatable lighting apparatus as claimed in claim 1, wherein the base comprises a receding part, the protruding part is located on a bottom surface of the receding part, the heat dissipation part comprises a protruding portion, the restricting trenches are arranged on a surface of the protruding portion in a circular manner, the heat dissipation part extends correspondingly into the receding part of the base through the protruding portion, so that the protruding part in the receding part extends relatively into one of the restricting trenches of the protruding portion.

3. The rotatable lighting apparatus as claimed in claim 2, wherein the protruding portion comprises an opening on an axis of the rotatable lamp holder, and the passing-through device comprises:

a screw, passing through the base and the opening of the protruding portion; and a nut, disposed within an internal wall of the rotatable lamp holder and fixed on the screw which passes through the opening, so that movement of the rotatable lamp holder is restricted between the nut and the base.

4. The rotatable lighting apparatus as claimed in claim 1, wherein cross-sectional areas of the rotatable lamp holder perpendicular to the moving-axis gradually increase from the protruding portion towards the other end.

5. A rotatable lighting apparatus, comprising:

a terminal;

a base, wherein the terminal is fixed on the base, an end of the base opposite to the terminal comprises a protruding portion, and an outer wall of the protruding portion comprises at least one locking protruding ring;

a rotatable lamp holder, pivoted at the protruding portion of the base and comprising:

a heat dissipation part, comprising a receding part for housing the protruding portion, a circumference of the receding part comprises at least one locking receding ring for fastening to the locking protruding ring; and a lighting source, fixed on a single face of the heat dissipation part;

wherein after the locking receding ring is fastened to the locking protruding ring, the rotatable lamp holder only has one degree of rotational freedom relative to the axis of the base, and the angles of the rotational freedom exceeds 360 degrees.

6. The rotatable lighting apparatus as claimed in claim 5, wherein the rotatable lamp holder does not slide along a direction of the axis.

7. The rotatable lighting apparatus as claimed in claim 5, wherein the locking protruding ring and the locking receding ring are fastened uni-directionally.

8. The rotatable lighting apparatus as claimed in claim 6, wherein each of the locking protruding ring and the locking receding ring comprises an angular structure which faces the terminal, the locking protruding ring comprises a first slope, and the locking receding ring comprises a second slope which corresponds to the first slope.

9. The rotatable lighting apparatus as claimed in claim 5, wherein the outer wall of the protruding portion further comprises at least one protruding ring, and the heat dissipation part further comprises at least one receding ring for fastening to the protruding ring.

* * * * *